United States Patent [19]

Kong

[11] 4,095,718

[45] Jun. 20, 1978

[54] CONVERTIBLE SAFETY CAP

[76] Inventor: Cheung Tung Kong, 300 E. Bellevue Dr., Pasadena, Calif. 91101

[21] Appl. No.: 827,717

[22] Filed: Aug. 25, 1977

[51] Int. Cl.[2] ..... B65D 53/00

[52] U.S. Cl. ..... 215/223; 215/206; 215/350

[58] Field of Search ..... 215/206, 223, 224, 222, 215/350

[56] References Cited

U.S. PATENT DOCUMENTS

| | | | |
|---|---|---|---|
| 3,926,325 | 12/1975 | Benson | 215/206 |
| 3,980,194 | 9/1976 | Costa | 215/350 X |

*Primary Examiner*—George T. Hall

*Attorney, Agent, or Firm*—Christie, Parker & Hale

[57] ABSTRACT

A cap is provided for closing a container having a locking portion for use in a precautionary arrangement to prevent children from obtaining access into the container. The cap is convertible so as to cooperate with such a container to provide not only such a precautionary arrangement but also an alternative easy open arrangement.

6 Claims, 2 Drawing Figures

CONVERTIBLE SAFETY CAP

BACKGROUND OF THE INVENTION

In general, this invention relates to closure arrangements for containers of medicine and the like. More particularly, it relates to a cap adapted to cooperate with such a container to provide a precautionary arrangement and to be converted to provide an alternative easy open arrangement.

Various patents each disclose a combination involving a container and a cap that cooperate to define a precautionary arrangement directed to preventing children from removing the cap from the container. These patents give comprehensive explanations of the reasons why such a precautionary arrangement is needed; see, for example, U.S. Pat. No. 3,749,270.

A characteristic of such a precautionary arrangement is that a complex manipulation is required to remove the cap from the container. Typically such a complex manipulation involves, firstly, rotating the cap relative to the container until two position indicators, one on the cap and the other on the container, are brought into alignment, and then, secondly, lifting the cap off the container. Unless the cap is so angularly aligned with respect to the container, the cap is locked to the container. To achieve this locking, there is provided a radially projecting tab and a C-shaped flange that defines a notch through which the tab can pass. The tab can be on the cap and project radially inwardly for use with a complementary locking means involving such a C-shaped flange on the container. In an equivalent arrangement, the tab is on the container and projects radially outwardly therefrom, and the C-shaped flange is on the cap.

Athough such a precautionary arrangement is advantageous in circumstances where the need for safety exists, it constitutes a nuisance in other circumstances. For example, many elderly people never have small children in their homes. Moreover, owing to their age or to an affliction such as arthritis, such older people may be lacking in manual dexterity and accordingly find it difficult and sometimes impossible to remove the cap from the container so that they can take the medicine they need. Separately, the pharmacists who dispense the medicine fill many containers during a working day and are continually removing and replacing the caps. Owing to the complex manipulation described above, done repeatedly, the pharmacists suffer discomfort and irritation of their fingers and hands.

The foregoing problem arising from such precautionary arrangements has led to various proposals as to reversible closures. Examples of such a reversible closure are disclosed in U.S. Pat. Nos. 3,865,267, and 3,926,325. Each of these patents teaches a cap having a plug section at one end and having means defining a container-receiving recess at its opposite end.

There are drawbacks underlying the approach of providing such a plug/recess structure. It will be appreciated that cleanliness is especially important in this area. For this, and other reasons, the manufacturers who supply the containers and caps to dispensing pharmacists usually do so with the cap in place on the container. With a conventional precautionary arrangement, the container-receiving recess in the interior of the container cannot be contaminated during shipping and handling. However, with such a plug/recess structure, either the plug or the container-receiving recess is exposed during shipping and handling and thereby is likely to become contaminated unless additional provision is made for cleanliness.

SUMMARY OF THE INVENTION

This invention is directed to overcoming the above-described problems and drawbacks. In accordance with the invention, there is provided a cap for a container of the type having locking means for use in a precautionary arrangement to prevent children from obtaining access into the container. The cap is convertible so as to cooperate with such a container to provide not only such a precautionary arrangement but also an alternative easy open arrangement to simplify separation of the cap from the container.

The cap comprises a cover wall, and a side wall integral with the cover wall and projecting therefrom to define a container-receiving recess. On the interior of the side wall there is provided complementary locking means at a position spaced from the cover wall, for use in the precautionary arrangement to engage with the container locking means to ensure that the cap can be separated from the container only when the cap is aligned in predetermined angular relationship with the container.

Significantly, the cap further includes adjustable stopping means for use in converting between the precautionary and easy open arrangements. The stopping means comprises a member that, in the easy open arrangement, occupies a position within the recess to act as a stop limiting travel of the container into the recess so that in the easy open arrangement the complementary locking means and the container locking means do not engage. The side wall includes a gripping surface adapted to secure the cap to the container in the easy open arrangement. The stopping means member is movable from said position to enable further travel of the container into the recess so that in the precautionary arrangement the complementary locking means and the container locking means are engageable.

The structural features broadly recited above provide significant advantages with respect to simplicity of construction, and ease of use. Separately, it will be appreciated that a cap in accordance with the invention provides advantages with respect to maintaining sanitary conditions during shipping and handling of the cap and the container with which it is used.

In the ensuing description of alternate embodiments of the invention, there are set forth additional significant features that are set forth in the appended claims.

DETAILED DESCRIPTION

Figure 1:
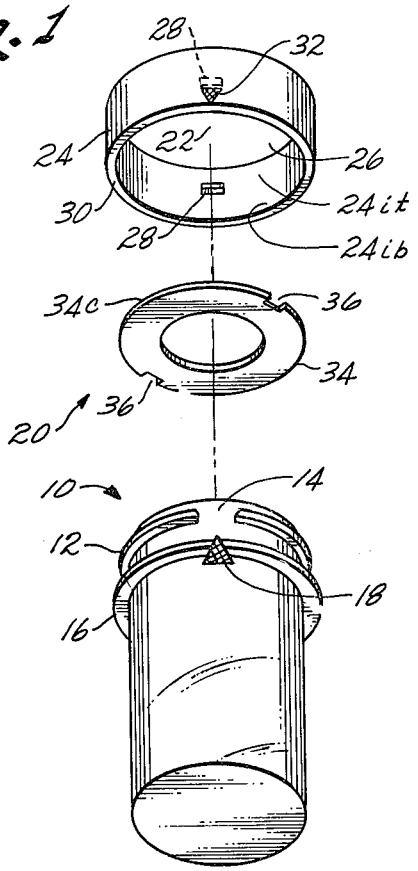
FIG. 1 is an exploded, perspective view of a container and convertible cap therfor, the depicted convertible cap being a first embodiment of the invention.

FIG. 1 shows, among other things, a cylindrical container 10 suitable for use in combination with a convertible cap embodying the invention.

A locking rim portion 12 of container 10 is axially spaced just below the mouth of container 10. Rim portion 12 is notched at diametrically opposed angular positions with such a notch 14 being visible in the perspective of FIG. 1.

A solid rim portion 16 of container 10 is axially spaced below locking rim portion 12, and an indicator 18 is defined on the surface of solid rim portion 16.

FIG. 1 also shows a convertible cap generally indicated at 20. Cap 20 includes a cover wall 22 and a cylindrical side wall 24 that is integral with cover wall 22 and projects therefrom to define a container-receiving recess 26.

On the interior of side wall 24 there are provided a pair of diametrically opposed tabs 28 that project inwardly into recess 26 in a common plane spaced approximately midway between the plane of cover wall 22 and the plane defined by the mouth 30 of recess 26.

The portion of cap 20 that has so far been described is adapted to cooperate with container 10 to provide a precautionary arrangement. In this connection, and indicator 32 is provided on the exterior surface of side wall 24. By manually aligning indicator 32 with indicator 18, tabs 28 are brought into alignment with notches 14, whereby the upper portion of container 10 can be inserted into recess 26. While effecting this insertion, tabs 28 pass through notches 14. After tabs 28 clear notches 14, a twisting action effects a locking closure.

A significant feature of this invention resides in the provision of stopping means for use in converting between a precautionary arrangement and an easy open arrangement. In the embodiment depicted in FIG. 1, the stopping means comprises a disk member 34.

The outer diameter of disk member 34 is approximately equal to the inner diameter of circumferential side wall 24 such that disk 34 can be inserted into a position (easy open position) within recess 26 such that it has its circumferential surface **34*c* in snug contact with surface 24*ib* which defines the bottom inner surface of side wall 24. Disk 34 has notches 36 so that upon proper alignment, disk 34 can be inserted into a deeper position (precautionary position) within recess 26, with tabs 28 passing through notches 36 as disk 34 is so further inserted. After such further insertion, surface 34*c* is in snug contact with surface 24*it* which defines the top inner surface of side wall 24. To assist in moving disk 34 between these two positions, disk 34** preferably is annular.

With disk 34 in its easy open position, container 10 can be inserted into recess 26 to only a relatively limited extent. In particular, it slides into the recess until its mouth butts into disk 34 which acts as a stop limiting further travel into the recess. With its travel being so limited, the complementary locking means comprising tabs 28 and notches 14 do not engage. To ensure a tight closure, the outer diameter of locking rim portion 12 is approximately equal to the inner diameter of circumferential side wall 24. It will be appreciated that surface **24*ib* defines a gripping surface adapted to releasably secure cap 20 to container 10** in the easy open arrangement.

To convert cap 20 to the precautionary arrangement, disk 34 can also be removed entirely, but it is preferable to move it deeper into the recess as described above where it in effect is stored for possible later use in the easy open arrangement.

Figure 2:
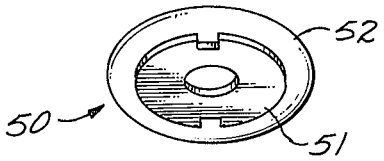
FIG. 2 is a perspective view of an adjustable stopping element used in a second embodiment of the invention.

With reference to FIG. 2, a stop member 50 is used in a second embodiment of the invention. Stop member 50 comprises a lower annular disk 51 and a spongy anvil top portion 52 adhesively secured to disk 51. Stop member 50 is inserted into recess 26 in place of disk 34 for the second embodiment. Because spongy portion 52 flares radially outwardly it can provide a good friction fit to keep stop member 50 contained in recess 26. When container 10 is inserted into recess 26 with stop member 50 therein, disk 51 acts as a stop limiting travel so long as relatively slight pressure is applied in effecting closure. By applying sufficient force to compress spongy portion 52, container 10 can travel deeper into recess 26 and thereby effect engagement of the complementary locking means.

The foregoing specifically described embodiments illustrate the principles of this invention, and it will be appreciated that additional embodiments in accordance with these principles are within the scope of this invention.

I claim:

1. A cap for a container of the type having locking means for use in a precautionary arrangement to prevent children from obtaining access into the container, the cap being covertible so as to cooperate with such a container to provide not only such a precautionary arrangement but also an alternative easy open arrangement to simplify separation of the cap from the container, the cap comprising:

a cover wall;

a side wall integral with the cover wall and projecting therefrom to define a container-receiving recess;

complementary locking means, located on the interior of the side wall at a position spaced from the cover wall, for use in the precautionary arrangement to engage with the container locking means to ensure that the cap can be separated from the container only when the cap is aligned in predetermined angular relationship with the container;

adjustable stopping means for use in converting between the precautionary and easy open arrangements;

the stopping means comprising a member that, in the easy open arrangement, occupies a position within the recess to act as a stop limiting travel of the container into the recess so that in the easy open arrangement the complementary locking means and the container locking means do not engage;

the side wall including a gripping surface adapted to releasably secure the cap to the container in the easy open arrangement; and said member being movable from said position to enable further travel of the container into the recess so that in the precautionary arrangement the complementary locking means and the container locking means are engageable.

2. A cap according to claim 1 wherein said member is a disk.

3. A cap according to claim 1 wherein said member is an annular disk.

4. A cap according to claim 1 wherein said member is a disk having an outer diameter such that its circumferential surface is in friction contact with said gripping surface while the disk occupies the stop position.

5. A cap according to claim 1 wherein said member is a disk and wherein said stopping means further includes a spongy element secured to the disk.

6. A cap according to claim 1 for use with such a container whose locking means is defined by a notched locking rim, wherein said member comprises a notched disk and wherein said complementary locking means comprises at least one tab projecting into the recess from the side wall.

* * * * *